US006279266B1

(12) United States Patent
Searcy

(10) Patent No.: US 6,279,266 B1
(45) Date of Patent: Aug. 28, 2001

(54) SCHOOL BUS WINDOW WITH SINGLE-ACTION SPLIT-SASH RELEASE MECHANISM

(76) Inventor: Jeffrey Thomas Searcy, 7612 Rustling Rd., Austin, TX (US) 78731

( * ) Notice: Subject to any disclaimer, the term of this patent is extended or adjusted under 35 U.S.C. 154(b) by 0 days.

(21) Appl. No.: 09/575,498

(22) Filed: May 18, 2000

Related U.S. Application Data

(62) Division of application No. 08/946,720, filed on Oct. 8, 1997, now abandoned.

(51) Int. Cl.[7] ..... E05D 15/22
(52) U.S. Cl. ..... 49/183; 49/141; 292/38
(58) Field of Search ..... 49/181, 182, 183, 49/394, 395, 141, 449, 379; 292/38, 40, 171, 173, 153, 141

(56) References Cited

U.S. PATENT DOCUMENTS 3,617,080 * 11/1971 Miller ..... 292/38
3,834,747 * 9/1974 Slovensky, Jr. ..... 292/38
4,003,047 * 1/1977 Johnson ..... 340/274
4,199,176 * 4/1980 Kelly ..... 292/38
4,395,892 * 8/1983 Remington ..... 70/312
4,475,311 * 10/1984 Gibson ..... 49/449
4,553,353 * 11/1985 Simpson ..... 49/449
4,901,475 * 2/1990 Simpson ..... 49/449
5,072,464 * 12/1991 Draheim et al. ..... 5/93.1
5,169,205 * 12/1992 James ..... 296/146

* cited by examiner

*Primary Examiner*—Daniel P. Stodola
*Assistant Examiner*—Curtis A. Cohen

(57) ABSTRACT

A school bus split-sash window with a latch release bar than can be pushed with the upward motion of one thumb. In the preferred embodiment, two normally-extended spring loaded release pins are retracted by tension on cables which are pulled around fixed stanchions in the window frame when the release bar is pushed up. The window can be opened by one hand.

3 Claims, 3 Drawing Sheets

SCHOOL BUS WINDOW WITH SINGLE-ACTION SPLIT-SASH RELEASE MECHANISM

RELATED APPLICATIONS

This application is a Div. of Ser. No. 08/946,720 which was filed by applicant on Oct. 8, 1997 and abandoned.

FIELD OF INVENTION

The preferred embodiment of this invention relates to a release mechanism and window for vehicles such as school buses.

BACKGROUND

Split-sash windows are the type most often used in school buses. They are used in all states and are mandatory in many. Split-sash is a design whereby two panes of glass, an upper and lower pane, constitute the window. Both pieces of glass are typically held with aluminum framing around their perimeters. The lower piece is fixed-in-place and the upper pane slides down to open and up to close. The purpose of the opening is to allow for ventilation. The upper pane is typically held in place with two spring-loaded bolts, located in the top rail of the pane's frame, one on each side of the upper pane. These bolts are plastic and/or metal and protrude from the upper pane and engage ratchets or stops which are part of the outer window frame surrounding the panes. The upper pane is moved by moving the bolts inward and against the spring (lateral pressure), so that the ends of the bolt no longer rest in the notches, and freeing the pane to move up or down. The bolts have finger holds, which are formed-in recesses, that require two hands, one per bolt, to pinch the bolts simultaneously toward each other to free the window.

The present design is inefficient for several reasons. First, a sustained lateral force is needed to free the windowpane in conjunction with vertical force (up or down) to move the pane. Thus the hands are working in a different direction than the arms. Second, the lateral force is against the sides of the fingers, usually the forefinger of each. This is a difficult maneuver to sustain since the strength and natural motion of the fingers is toward the palms. Third, the present window is difficult for small children, as their hands are smaller, their fingers are weaker and their coordination is less developed to handle such a task well. Fourth, the window is more likely to get stuck since the bolts are operated independently. One side can be unlatched and moved down while the other side remains latched binding the window in that position. Fifth, two hands are required to open or to close the window.

The primary objective of this invention is to make a split-sash window that is easier to open and to close than the prior art. This objective is achieved by utilizing a vertical force to release the window by using a latch system that requires only one hand, and by linking the two bolts to a central release so that the window is less likely to bind.

This invention aligns the vertical force of the hand in releasing the bolts with the vertical force of the arm or arms in opening or closing the window. This alignment is achieved by using a window latch system that allows the user to use vertical force to release the horizontally mounted bolts from their stops. Since the window slides vertically, using a thumb-bar that requires vertical force to unbolt the window will allow easier opening, since all forces will be aligned. Present windows use two finger-latches that require horizontal force using two hands. The index fingers are required to push laterally while simultaneously the remaining fingers and thumb raise or lower the windowpane.

The thumb bar requires only one hand to unbolt the window from its stops. In addition to making the window easier to operate, it allows for use with only one hand. Locating the thumb-bar at the center of the top horizontal beam, and connecting both bolts to this one thumb bar, puts the operation interface at one central area on the window, allowing for only one thumb pressing vertically to open the window. Riders with only one hand or one hand free can operate the window.

With the new latch mechanism, the window will be less likely to bind itself into one position. By utilizing one release mechanism for the release of both bolts, there is no longer a requirement for both hands to release each side simultaneously. The single mechanism pulls both bolts inward at the same rate, freeing both sides of the window at the same moment.

BRIEF DESCRIPTION OF THE DRAWINGS:

These and other features, aspects, and advantages of the present invention will become better understood with regard to the following description, appended claims, and accompanying drawings where:

DESCRIPTION OF THE PREFERRED EMBODIMENT

There are numerous mechanisms that someone skilled in the art might utilize to convert the vertical force of the thumb bar into lateral force that draws the bolts inward. The language and the use of the pulley system as the design choice is for example only.

Figure 1:
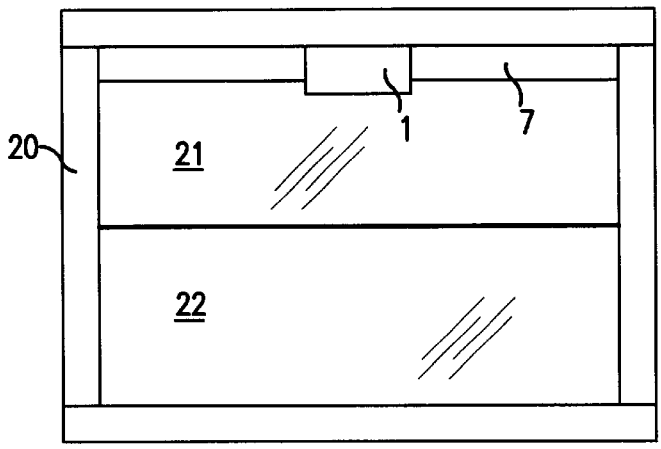
FIG. 1 is a front view of a split-sash window in a closed position.
Figure 2:
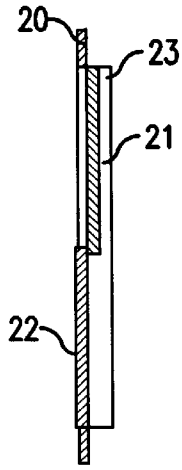
FIG. 2 is a side view of a split-sash window in a closed position.
Figure 3:
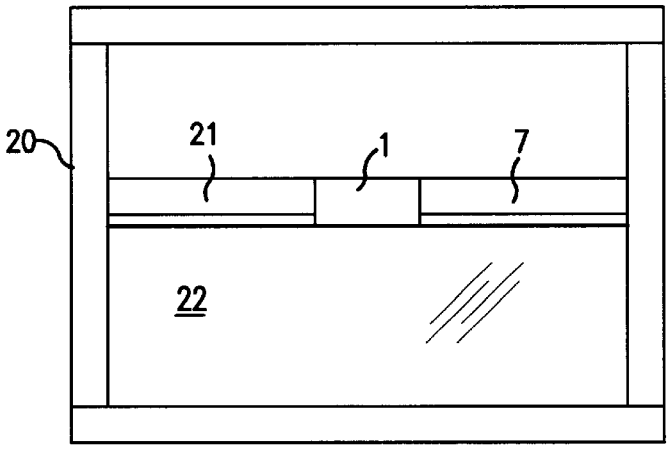
FIG. 3 is a front view of a split-sash window in an open position.
Figure 4:
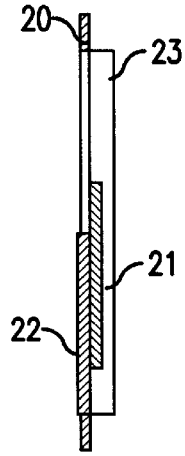
FIG. 4 is a side view of a split-sash window in an open position.

FIGS. 1 through 4 are conceptual drawings of the entire window. The Black rectangle is the thumb bar, which actuates the release of the window. FIG. 1 shows the front view of a closed window. FIG. 2 shows a cross section of a closed window. FIGS. 3 and 4 show the window in the open position.

Figure 5:
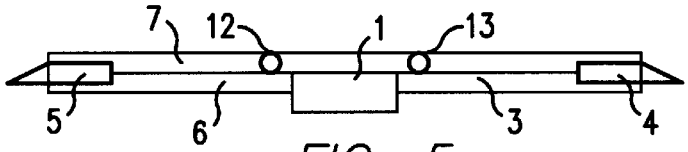
FIG. 5 is a front view schematic of a pulley latch mechanism in a latched position.
Figure 6:
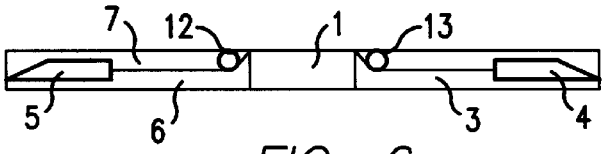
FIG. 6 is a front view schematic of a pulley latch mechanism in an unlatched position.
Figure 7:
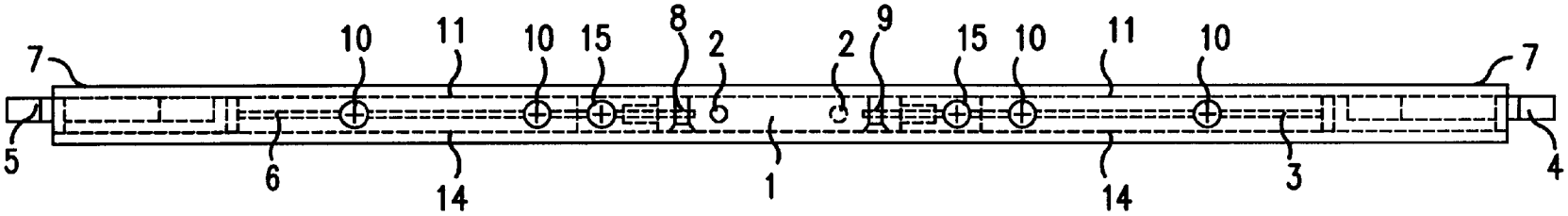
FIG. 7 is a top view of the top rail of the sliding window of FIG. 1.
Figure 8:
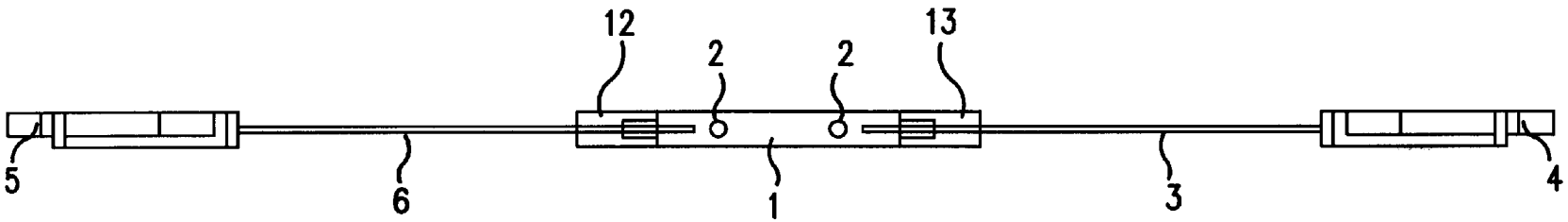
FIG. 8 is a simplified top view of the top rail of the sliding window of FIG. 1, showing the latch mechanism.
Figure 9:
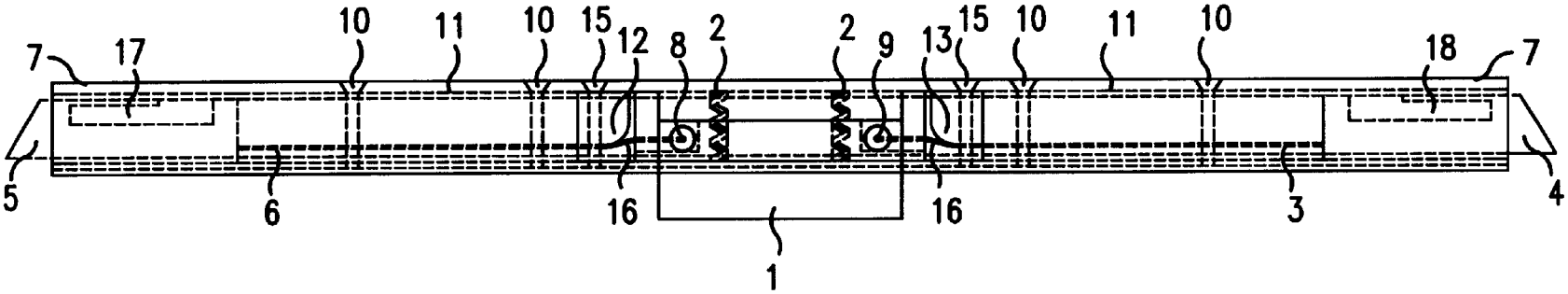
FIG. 9 is a front view of the top rail of the sliding window of FIG. 1.
Figure 10:
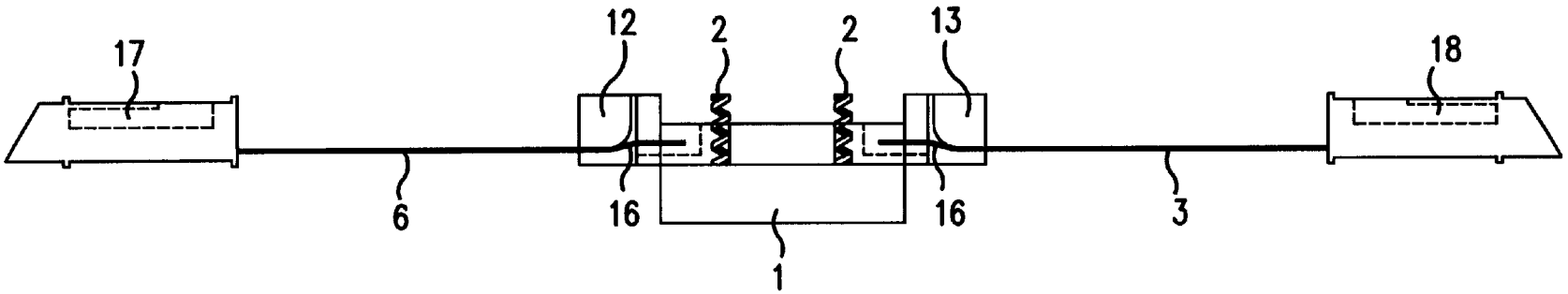
FIG. 10 is a simplified front view of the top rail of the sliding window of FIG. 1, showing the latch mechanism.

FIGS. 5 and 6 show a simple pulley system to illustrate the means by which vertical force is used to pull-in the bolts laterally. The pulley system works by connecting spring-loaded bolts 4 and 5 to each other with a wire 6, through a 90□ turn imbedded in a base, created by stanchions 12 and 13 on each side of the thumb bar. The thumb bar, when pushed up, pushes up the wire, which in turn pulls the bolts in on each side. Conversely, when the thumb bar is released, it releases pressure on the bolts enabling springs to push them back into their latched position. FIG. 5 is a conceptual drawing of the pulley system in the relaxed or latched position. FIG. 6 shows the thumb bar pushed upward so that the cords are drawn inward on each side, with the bolts now in their unlatched or released position. FIGS. 7 through 11 are drawings of a more sophisticated pulley-type system.

Referring to FIGS. 1 through 4, the window is a rectangle with the base typically longer than the height. The lower pane of glass is fixed 22 and is flush with the outer window frame 20. The upper pane 21 is moveable and slides within a fixed groove in the inner window frame 23, upwards and downwards. The sliding action of the window is vertical, but this request envisions that the window may slide horizontally as well. The upper pane 21 is operated by grabbing the top rail of the sliding window with four fingers on top of the top rail 7, or within finger grooves on the faceplate 7, and thumb on the thumb bar 1. One or two hands are needed.

Referring to FIGS. 7 through 10, the hand(s) squeeze, forcing the thumb bar upward against springs 2 imbedded in the thumb bar. Chords 3 and 6 are attached to the thumb bar with screws called chord terminals 8 and 9. These chords run through stanchions 12 and 13 on each side of the thumb bar. The stanchions are set in place with screws 15 and serve as a left hand guide 12 and a right hand guide 13 for the thumb bar, keeping the thumb bar square while it travels up and down. The stanchions also serve as guides for the chords such that when the thumb bar moves upward, the chords travel through grooves 16 in the stanchions that transition the chords from horizontal travel to vertical travel by way of a 90° curve in the groove. The left and right chords are attached to latch bolts 4 and 5 on the end of each side of the window rail. The latch bolts slide horizontally within the frame, and are held in place with latch bolt guides, upper 11 and lower 14, and springs located in the spring slots 17 and 18 within the bolts. The springs keep horizontal force on the bolts, pushing them toward the extended position. Thus with the vertical travel of the thumb bar translated into horizontal pull on the 3 and right 6 chords the chords will pull left 5 and right 4 latch bolts inward whenever the thumb bar is moved upward. Then, releasing the thumb bar allows the springs to push the bolts to their original, latched position and as the bolts move outward, the pull the cord with them, moving the thumb bar to its original position.

What is claimed is:

1. A school bus split-sash window comprised of:

a first fixed pane;

a second pane; movable with respect to the first fixed pane;

a frame incorporating the second pane, the frame having a first side and having a second side opposite of the first side;

a first spring-loaded latch positioned integral to the first side of the frame such that the first latch is held in a normally extended position relative to the frame;

a second spring-loaded latch positioned integral to the second side of the frame such that the second latch is held in a normally extended position relative to the frame;

a latch release bar movably positioned between a first stanchion and a second stanchion, the stanchions are integral to the frame;

a first cable connecting the first spring-loaded latch to the latch release bar, so that a force, to be applied by an external means, applied to the release bar which moves the release bar between the first and second stanchions pulls the first cable partially around the first stanchion and causing the first spring-loaded latch to revert to an extended position with respect to the frame; and a second cable connecting the first and second spring-loaded latch to the latches release bar, so that the force applied to the release bar moves the release bar between the first and second stanchions thereby pulling the second cable partially around the second stanchion and causing the second spring-loaded latch to draw inward with respect to the frame, and the release of the force allows the second spring-loaded latch to revert to the extended position with respect to the frame.

2. A school bus split-sash window as described in claim 1 wherein force is an upwardly acting force to be applied by an external means.

3. A school bus split-sash window as described in claim 1 wherein:

the first stanchion includes a first groove over a portion of its periphery to accept the first cable, the portion including an arc of approximately ninety degrees to guide a change of direction of the first cable, so that as the force is applied, the release bar is moved relative to the first stanchion thereby pulling the first cable along the first groove, and when the force is released, the first cable is permitted to reverse its path along the first groove; and the second stanchion includes a second groove over a portion of its periphery to accept the second cable, the portion including an arc of approximately ninety degrees to guide a change of direction of the second cable, so that as the force is applied, the release bar is moved relative to the second stanchion thereby pulling the second cable along the second groove, and that when the force is released, the second cable is permitted to reverse its path along the second groove.

* * * * *